US008925794B2

(12) United States Patent
Tawada et al.

(10) Patent No.: US 8,925,794 B2
(45) Date of Patent: Jan. 6, 2015

(54) SWING-OPEN TYPE PACKAGE

(75) Inventors: Shunsuke Tawada, Tokyo (JP); Tetsuya Nakamura, Tokyo (JP); Noriaki Mitsui, Tokyo (JP); Kouya Nakamura, Tokyo (JP); Nobuhiko Higashi, Tokyo (JP); Hideki Mori, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 313 days.

(21) Appl. No.: 12/862,413

(22) Filed: Aug. 24, 2010

(65) Prior Publication Data

US 2010/0320263 A1 Dec. 23, 2010

Related U.S. Application Data

(63) Continuation of application No. PCT/JP2009/052724, filed on Feb. 18, 2009.

(30) Foreign Application Priority Data

Feb. 25, 2008 (JP) ..... 2008-042857

(51) Int. Cl.

| | |
|---|---|
| ***B65D 43/16*** | (2006.01) |
| ***B65D 85/10*** | (2006.01) |
| ***B65D 5/66*** | (2006.01) |

(52) U.S. Cl.

CPC ..... *B65D 5/6697* (2013.01); *B65D 85/1009* (2013.01)

USPC ..... 229/125.11; 229/160.1

(58) Field of Classification Search

USPC ..... 229/125.11, 125.02, 128; 206/270, 266, 206/271, 760, 754, 759, 757, 755, 249, 251, 206/250

See application file for complete search history.

(56) References Cited

U.S. PATENT DOCUMENTS

| | | | | |
|---|---|---|---|---|
| 2,964,228 | A * | 12/1960 | Cote et al. | 229/147 |
| 3,400,874 | A * | 9/1968 | Shimada et al. | 206/250 |
| 3,708,108 | A * | 1/1973 | Rosenburg, Jr. | 229/225 |
| 4,413,726 | A * | 11/1983 | Davidson | 206/45.29 |
| 5,040,722 | A | 8/1991 | Fromion et al. | |
| 6,105,856 | A | 8/2000 | Kakiuchi | |
| 6,527,166 | B1 * | 3/2003 | Focke et al. | 229/146 |
| 6,719,131 | B1 * | 4/2004 | Focke et al. | 206/268 |

FOREIGN PATENT DOCUMENTS

| | | |
|---|---|---|
| DE | 1 090 572 | 10/1960 |
| JP | 50-16738 | 5/1975 |
| JP | 59-60122 U | 4/1984 |
| JP | 3-639 A | 1/1991 |

(Continued)

*Primary Examiner* — Nathan J Newhouse
*Assistant Examiner* — Christopher Demeree
(74) *Attorney, Agent, or Firm* — Birch, Stewart, Kolasch & Birch, LLP

(57) ABSTRACT

A swing-open type package has a box body (10), a lid (12) to be put onto the box body (10) from above, and a swing device connecting the lid (12) and the box body (10), the swing device including a movable rear wall portion (36) formed by a part of a rear wall of the box body (10), and a support flap (44) connecting the lid (12) and a transverse wall (21) of the box body (10), and enables a swing motion of the lid (12) when a front wall of the lid (12) is raised from the boxy body (10) so that the swing motion causes the lid (12) to tilt and open wide.

17 Claims, 6 Drawing Sheets

(56) References Cited

FOREIGN PATENT DOCUMENTS

| | | | |
|---|---|---|---|
| JP | 10-129656 | A | 5/1998 |
| JP | 2002-284139 | A | 10/2002 |
| JP | 3095583 | U | 8/2003 |
| WO | 2008/006471 | A1 | 1/2008 |

* cited by examiner

SWING-OPEN TYPE PACKAGE

This application is a Continuation of PCT International Application No. PCT/JP2009/052724 filed on Feb. 18, 2009, which claims the benefit of Patent Application No. 2008-042857 filed in Japan on Feb. 25, 2008. The entire contents of all of the above applications is hereby incorporated by reference into the present application.

TECHNICAL FIELD

This invention relates to a swing-open type package suited to hold rod-shaped articles such as filtered cigarettes.

BACKGROUND ART

For example, a flat box such as a box of sweets comprises a box body open at the top and a lid for opening and closing the open top of the box body. The open top of the box body can be closed by putting the lid onto the top of the box body (patent document 1, for example). In the box as disclosed in patent document 1, access to the open top is given by lifting and removing the lid from the box body, and articles can be easily removed from inside the box body through the open top of the box body.

PRIOR-ART DOCUMENT

Patent document 1: Japanese Patent Application KOKAI Publication No. 2002-284139

DISCLOSURE OF THE INVENTION

Problem to be Solved by the Invention

The box disclosed in patent document 1 comprises a box body and a lid provided as two separate parts. The lid removed is therefore turned upside down and fitted onto the bottom of the box body, or put elsewhere than the box body is placed. The lid is thus not convenient to handle.

Further, unless the box body and the lid are a perfect square in shape, the removed lid needs to be orientated to the same direction as the box body for putting back onto the box body. The lid is therefore not convenient to put back onto the box body, either.

An object of the present invention is to provide a swing-open type package allowing a box body to be opened wide and providing easy handling of a lid after the box body is opened.

Means for Solving the Problem

In order to achieve the above object, a swing-open type package according to the present invention comprises a rectangular box body including a bottom wall, a front wall, a rear wall and a pair of side walls; a rectangular lid put onto the box body from above, including a top wall, a front wall, a rear wall and a pair of side walls corresponding to the bottom wall, front wall, rear wall and side walls of the box body, respectively, and a swing device connecting the box body and the lid and enabling a swing motion of the lid which causes the lid to move backward from the box body and tilt with the rear wall down, when the front wall of the lid is raised from the box body.

In the above-described package, when the front wall of the lid is raised from the box body on the condition that the front wall of the lid is put onto the box body, the lid moves backward from the box body and tilts with the rear wall down. The lid tilted relative to the box body in this manner provides a large space allowing access to the front side of the box body.

Then, a swing motion of the lid in the reverse direction causes the lid to move forward and come down toward the box body, so that the lid is put back onto the box body, or in other words, the package is closed again.

Specifically, the swing device can include a movable rear wall portion formed by a part of the rear wall of the box body and joined to the bottom wall of the box body by a hinge, and a connection flap extending from an upper edge of the movable rear wall portion and connected to an inner surface of the lid.

Such movable rear wall portion and connection flap enable the swing motion of the lid, keeping the box body and the lid connected together.

The swing device can further include a transverse wall provided at a predetermined distance from the front wall of the box body to connect respective upper edges of the left and right side walls of the box body and define an access opening between the transverse wall and the front wall of the box body, and a support flap connecting the transverse wall and the inner surface of the lid, where the support flap having hinges at the connecting potions with respect to the transverse wall and the inner surface of the lid, respectively, so that the support flap enables the swing motion of the lid by bending along the respective hinges. Such support flap guides the swing motion of the lid, thereby stabilizing the trajectory of the lid in its swing motion.

In a preferred embodiment, the left and right side walls of the lid each have a finger engagement portion formed by a notch on a lower edge of the side wall. Such finger engagement portions make it easy to raise the lid from the box body.

In a preferred embodiment, the swing device further includes a cut-out formed in the transverse wall, where the cut-out is adapted to receive the connection flange when the lid is put onto the box body. In this case, the connection flange does not prevent the upper wall of the lid from being satisfactorily brought into contact with the transverse wall of the box body when the lid is put onto the box body.

Further, the provision of the cut-out makes it possible to form the box body, the movable rear wall portion, the connection flap and the transverse wall from a single blank.

The swing-open type package may further comprise a sound generation device for generating a clicking sound when the lid is put onto the box body. Specifically, the sound generation device includes a stopper tongue projecting outward from an upper edge of the front wall of the box body, and a recess formed in an inner surface of the front wall of the lid. In this case, in the way of putting the lid onto box body, when the front wall of the lid is placed on the front wall of the box body and the stopper tongue is received in the recess, the stopper tongue makes a clicking sound by hitting an edge of the recess with a distal end thereof. Such clicking sound allows the user to clearly recognize that the lid has been properly put onto the box body.

Effect of the Invention

In the swing-open type package according to the present invention, a swing motion of the lid is given by raising the lid from the box body. The swing motion of the lid provides a large space allowing access to the front side of the box body, thereby facilitating removal of articles from the box body. The lid is always kept connected to the box body by means of the swing device, which makes the lid easy to handle and open and close, and thus, makes the package easy to open and close.

BEST MODE OF CARRYING OUT THE INVENTION

Figure 1:
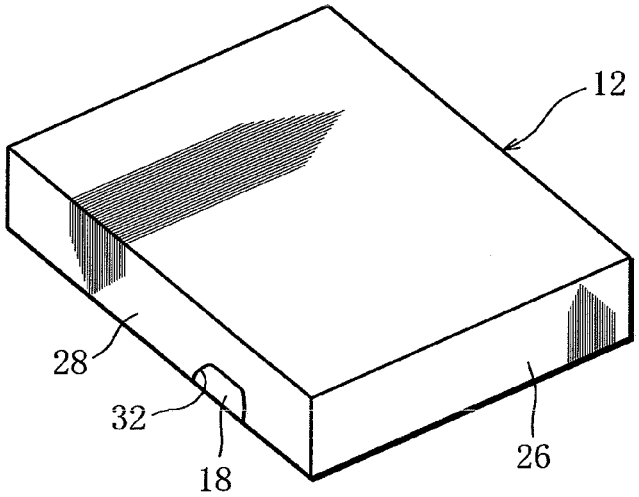
FIG. 1 is a perspective view showing an embodiment of a slide-open type package in a closed state.
Figure 2:
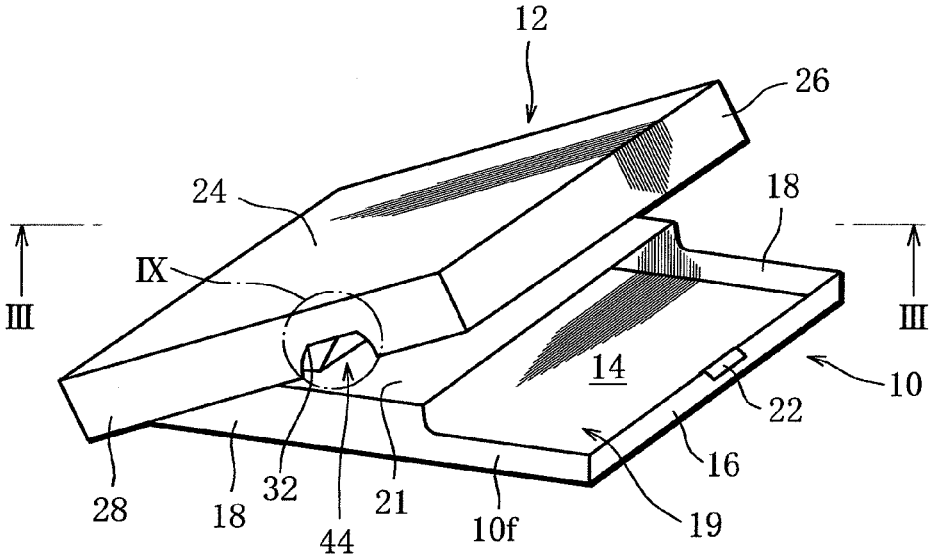
FIG. 2 is a perspective view showing the package shown in FIG. 1 in an open state.
Figure 3:
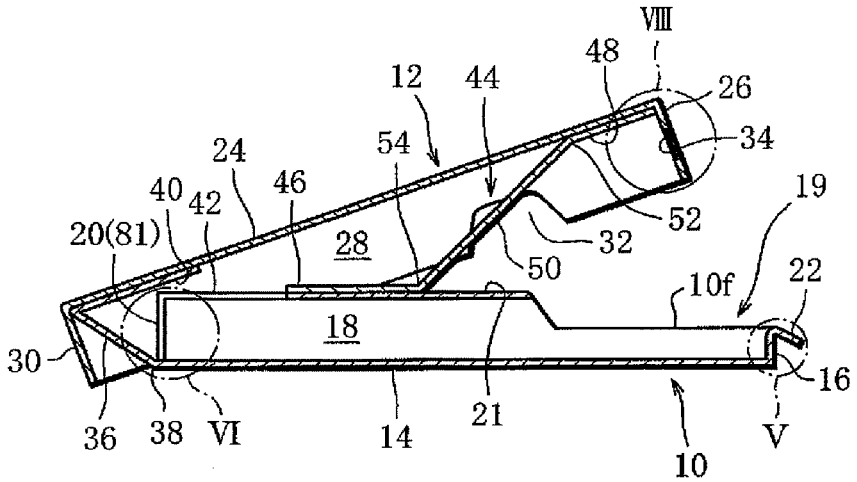
FIG. 3 is a cross-sectional view of the package along line III-III in FIG. 2.

FIGS. 1 to 3 show an embodiment of a swing-open type package.

The package comprises a thin, rectangular box body 10 and a lid 12 to be put onto the box body 10 from above. The lid 12 is similar in shape to the box body 10.

Specifically, the box body 10 is open at the top thereof, and has a bottom wall 14 and a circumferential wall surrounding the circumference of the bottom wall 14. The circumferential wall comprises a front wall 16, left and right side walls 18 and a rear wall 20 (FIGS. 2 and 3). The front portion 10*f* of the box body 10 is smaller in height than the rear of the box body 10. The left and right side walls 18 therefore have an upper edge indented on the front portions thereof. The box body 10 has a transverse wall 21 on the rear side. The transverse wall 21 extends over the width of the box body 10 and is joined to the upper edges of the left and right side walls 18 at the opposite ends. The box body 10 is thus provided with an access opening 19 defined between the front wall 16 and the transverse wall 21.

The box body 10 holds an inner pack (not shown), for example. The inner pack includes an array of rod-shaped articles, such as filtered cigarettes, cigarettes or the like, and a wrapper covering the array.

As clear from FIGS. 2 and 3, the front wall 16 has a stopper tongue 22 at the upper edge thereof. The stopper tongue 22 projects forward from the front wall 16 of the box body 10, and can be folded onto the front surface of the front wall 16.

The lid 12 has an upper wall 24 and a circumferential wall surrounding the circumference of the upper wall 24. The circumferential wall comprises a front wall 26, left and right side walls 28 and a rear wall 30. The lid 12 is put onto the box body 10 with the upper wall 24 of the lid 12 completely covering the opening and the transverse wall 21 of the box body 10 and the circumferential wall of the lid 12 overlying the circumferential wall of the box body 10. Each side wall 28 of the lid 12 has a notch on the lower edge thereof. The notch extends from the middle of the side wall 28 toward the front wall 26 of the lid 28 in the direction of the length of the side wall 28 to form a finger engagement portion 32

As shown in FIG. 3, the front wall 26 of the lid 12 has a recess 34 in the inner surface thereof. The recess 34 is adapted to receive the stopper tongue 22 of the box body 10 when the lid 12 is put onto the box body 10 to close the package. When the stopper tongue 22 and the recess 34 engage each other, these tongue and recess make a clear clicking sound. This clicking sound tells that the lid 12 has been properly put onto the box body 10, or in other words, the package has been properly closed.

More specifically, on the way to put the lid 12 onto the box body 10, the lid 12 is pushed down so that the front wall 26 thereof moves downward along the outer surface of the front wall 16 of the box body 10 with the inner surface of the front wall 26 in contact with the outer surface of the front wall 16. In this process, the front wall 26 folds the stopper tongue 22 of the front wall 16, and when the stopper tongue 22 fits into the recess 34 in the front wall 26, the distal end of the stopper tongue 22 hits the edge of the recess 34, so that a clear clicking sound is generated.

The box body 10 and the lid 12 are connected by means of a swing device. Next, the swing device will be described in detail.

The swing device includes a movable rear wall portion 36. The movable rear wall portion 36 is formed by a part of the rear wall 20 of the box body 10. Specifically, the rear wall 20 has a pair of slits 81 in the widthwise middle region thereof. The slits divide the rear wall 20 into three portions. The middle portion of the three is joined to the bottom wall 14 by a hinge 38 and forms the movable rear wall portion 36.

A connection flap 40 is joined to the upper edge of the movable rear wall portion 36 by a fold line. The connection flap 40 is bonded to the inner surface of the upper wall 24 of the lid 12 to extend from the rear wall 30 toward the front wall 26 of the lid 12. Such connection flap 40 connects the movable rear wall portion 36 of the box body 10 and the lid 12.

The transverse wall 21 of the box body 10 has a cut-out 42 (FIG. 3). The cut-out 42 extends from the rear wall 20 towards the front wall 16. The cut-out 42 is adapted to receive the connection flap 40 when the lid 10 is put onto the box body 10.

Further, as clear from FIG. 3, a support flap 44 connects the transverse wall 21 of the box body 10 and the upper wall 24 of the lid 12. The support flap 44 has connecting portions 46, 48 at the opposite ends. The connecting portions 46, 48 are bonded to the upper surface of the transverse wall 21 and the inner surface of the upper wall 24, respectively. The support flap 44 also has a middle portion 50 between the connecting portions 46, 48. The boundary between the middle portion 50 and the connecting portion 46 and the boundary between the middle portion 50 and the connecting portion 48 form hinges 52, 54, respectively.

As clear from the above description, the box body 10 and the lid 12 are connected by the movable rear wall portion 36 and connection flap 40 and the support flap 44, which constitute the swing device. Thus, when the user raises the front side of the lid 12 from the box body 10 in the closed package (FIG. 1), the movable rear wall portion 36 turns outward on the hinge 38 and the support flap 44 bends at the hinges 52, 54. Such turning of the movable rear wall portion 36 and bending of the support flap 44 enables a swing motion of the lid 12 as seen from FIGS. 2 and 3. The swing motion causes the lid 12 to move backward and tilt with the rear wall 30 down and the front wall 26 up, thereby providing a large space allowing access to the front side of the box body 10. Consequently, the user can easily remove the rod-shaped articles from inside the box body 10 through the access opening 19.

Then, when the user pushes the lid 12 down obliquely toward the front wall 16 of the box body 10, the swing device operates reversely, so that the lid 12 is properly put onto the box body 10 from above to close the package again.

Regardless of whether the package is open or closed, the lid 12 is always kept connected to the box body 10. The lid 12 not separated from the box body 10 is convenient to handle.

Since the lid 12 has finger engagement portions 32 on the left and right sides, these engagement portions 32 make the lid or the package easy to open and close. Further, as stated above, the lid 12 makes a clear clicking sound when the lid 12 is properly put onto the box body 10. The user can therefore clearly recognize that the package has been closed.

Figure 4:
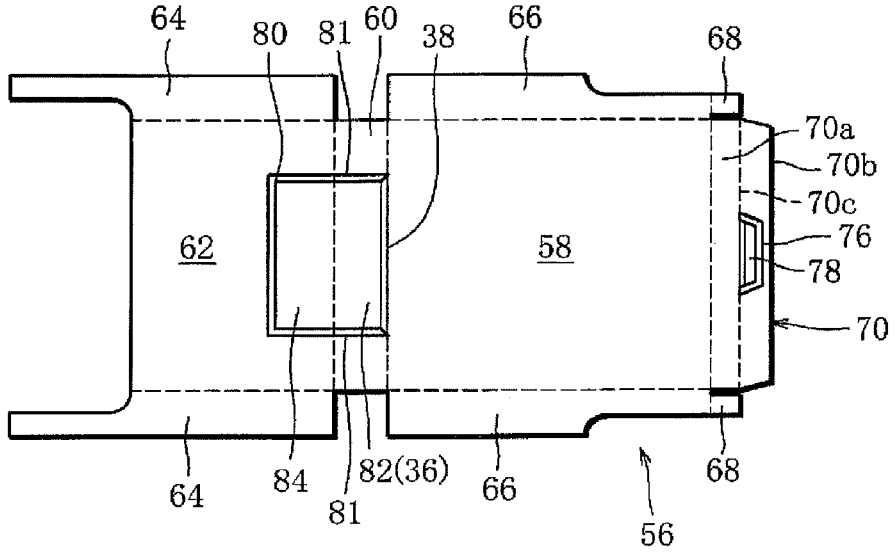
FIG. 4 shows a blank for forming the box body.

FIG. 4 shows a blank 56 for forming the box body 10. The blank 56 is divided into panels and flaps by fold lines indicated in broken line.

Specifically, the blank 56 includes a bottom panel 58, a rear panel 60 and an upper panel 62 to form the bottom wall 14, the rear wall 20 and the transverse wall 21 of the box body 10, respectively. These panels are aligned along the longitudinal axis of the blank 56, where the adjacent panels are joined by a fold line. Outer side flaps 64 are joined to the opposite side edges of the upper panel 62 by fold lines, respectively, and inner side flaps 66 are joined to the opposite side edges of the bottom panel 58 by fold lines, respectively. Each outer side flap 64 is laid over the corresponding inner side flap 66 to form a side wall 18 of the box body 10.

Each inner side flap 66 has a side front flap 68 joined to an end thereof by a fold line. The side front flaps 68 are provided at the side opposite the bottom panel 58 to serve as members reinforcing the front wall 16 of the box body 10.

A front flap 70 is joined to an edge of the bottom panel 58 by a fold line. The front flap 70 is located between the side front flaps 68. The front flap 70 has a fold line 70*c*. The fold line 70*c* divides the front flap 70 into an outer section 70*a* and an inner section 70*b*. The outer and inner sections 70*a* and 70*b* form the front wall 16 of the box body 10, together.

The inner section 70*b* has a cut 76 in the middle thereof. The cut 76 is a flat U shape. The cut 76 defines a to-be-raised portion 78 within the inner section 70*b*. The to-be-raised portion 78 provides the aforementioned stopper tongue 22.

The upper panel 62 has a cut 80. The cut 80 is approximately a U shape with its top directed to the bottom panel 58. The cut extends further in the rear panel 60 to reach the bottom panel 58. The cut 80 thus includes the aforementioned pair of slits defining the movable rear wall portion 36, and the line connecting the opposite ends of the cut 80 provides the aforementioned hinge 38. The hinge 38 is a part of a fold line between the bottom panel 58 and the rear panel 60. The cut 80 therefore defines a portion 82 which is to form the movable rear wall portion 36 within the rear panel 60, and a portion 84 which is to form the connection flap 40 within the upper panel 62. These portions 82, 84 are divided from each other by a fold line between the upper panel 62 and the rear panel 60.

Figure 5:
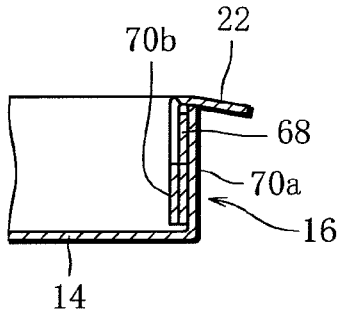
FIG. 5 is a detailed view of part V in FIG. 3.
Figure 6:
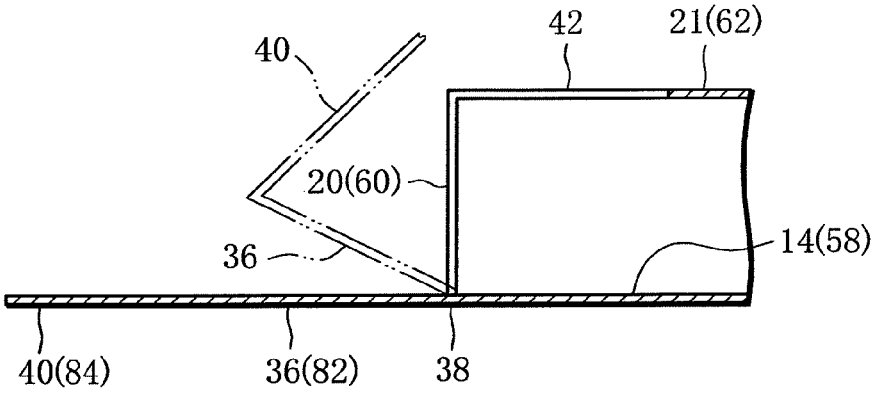
FIG. 6 is a view of part VI in FIG. 3 for explaining how a movable rear wall portion and a connection flap are formed.

FIG. 5 shows that the front wall 16 of the box body 16 has the outer and inner sections 70*a* and 70*b* of the front flap 70 and the side flaps 68. FIG. 6 shows that the rear panel 60 and upper panel 62 are folded, leaving the aforementioned portions 82, 84 aside. The portions 82, 84 left form the movable rear wall portion 36 and the connection flap 40, respectively.

Figure 7:
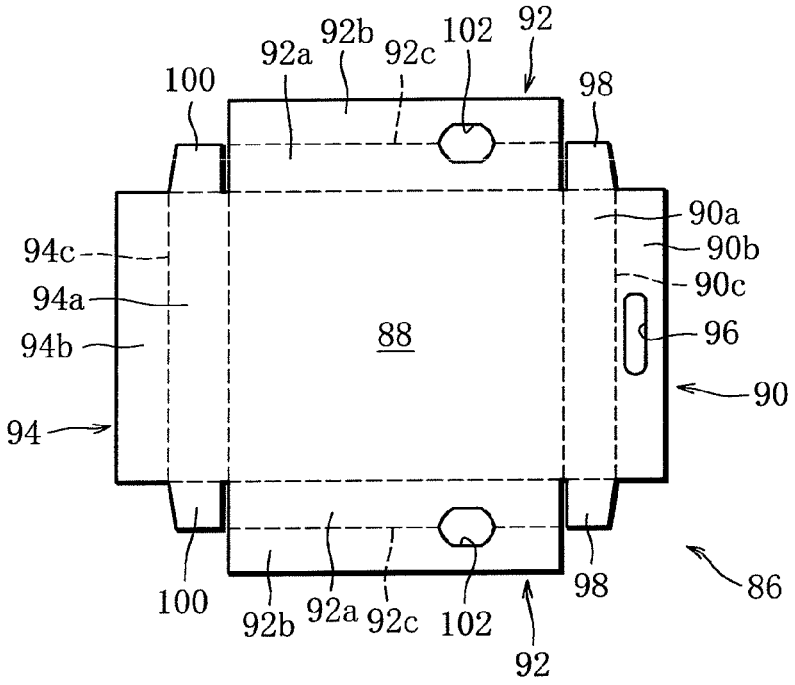
FIG. 7 shows a blank for forming the lid.

FIG. 7 shows a blank 86 for forming the lid 12. Also the blank 86 are divided into panels and flaps by fold lines indicated in broken line.

The blank 86 includes a rectangular top panel 88 to form the upper wall 24 of the lid 12. A front flap 90, left and right side flaps 92 and a rear flap 94 are joined to the four sides of the top panel 88 by fold lines, respectively. Like the aforementioned front flap 70, the flaps 90, 92, 94 are each divided into inner and outer sections by a fold line. In FIG. 7, for each of the flaps 90, 92, 94, the inner and outer sections and the fold line dividing the inner section from the outer section are denoted by adding subscripts a, b, c to the reference character denoting the flap, respectively. The flaps 90, 92, 94 form the front wall 26, left and right side walls 28 and rear wall 30 of the lid 12, respectively, by their inner section being laid over their outer section.

An opening 96 is formed in the inner section 90*b* of the front flap 90. This opening 96 provides the aforementioned recess 34. Further, flaps 98 and 100 are joined to the outer sections 90*a*, 94*a*, at their opposite side edges, by fold lines, respectively. The flaps 90, 100 serve as members reinforcing the side walls 28.

An opening 102 is formed in each side flap 92. The opening 102 is provided to expand across the fold line 92*c* between the outer and inner sections 92*a*, 92*b*. When the inner section 92*b* is laid over the outer section 92*a*, the opening 102 provides the finger engagement portion 32 of the side wall 18.

Figure 8:
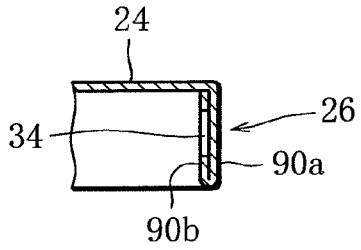
FIG. 8 is a detailed view of part VIII in FIG. 3.
Figure 9:
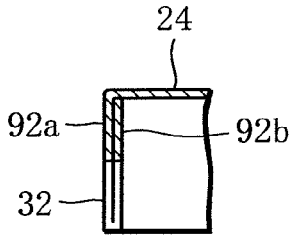
FIG. 9 is a cross-sectional view of part IX in FIG. 2.

FIG. 8 shows that the front wall 16 of the lid 12 has the inner and outer sections 90*a* and 90*b* of the front flap 90. FIG. 9 shows that the side wall 28 of the lid 12 has the inner and outer sections 92*a* and 92*b* of the side flap 92.

Figure 10:
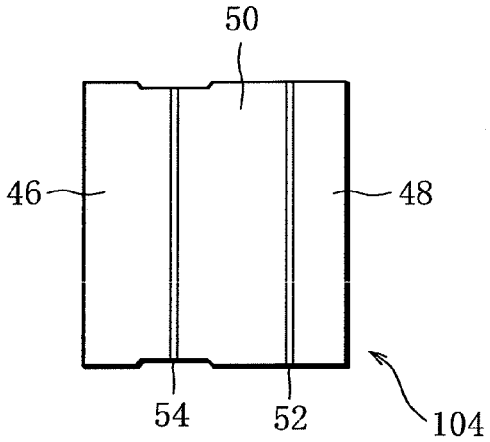
FIG. 10 shows a blank for forming a support flap.
Figure 11:
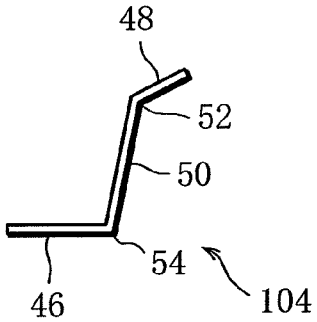
FIG. 11 shows the blank shown in FIG. 10, bent to form the support flap.

FIG. 10 shows a blank 104 for forming the aforementioned support flap 44, and FIG. 11 show the blank 104 bent at the hinges 52 and 54.

The present invention is not restricted to the above-described embodiment.

For example, the slide motion of the lid 12 can be achieved by a mechanism different from the above-described slide mechanism comprising the movable rear wall portion 36 and the support flap 44.

EXPLANATION OF REFERENCE CHARACTERS

10: Box body
12: Lid
21: Transverse wall (swing device)
22: Stopper tongue (sound generation device)
24: Upper wall
32: Finger engagement portion
34: Recess (sound generation device)
36: Movable rear wall portion (swing device)
40: Connection flap (swing device)
44: Support flap (swing device)
56: Blank
86: Blank
104: Blank

The invention claimed is:

1. A swing-open type package, comprising:

a rectangular box body including a bottom wall and a circumferential wall which has a front wall, a rear wall and a pair of side walls, a rectangular lid including a top wall and a circumferential wall which has a front wall, a rear wall and a pair of side walls, the circumferential wall of said rectangular lid overlying the circumferential wall of said box body when said rectangular lid is put onto said box body from above, and a swing device connecting said box body and said lid and enabling a swing motion of said lid which causes said lid to shift backward from said box body and tilt with the rear wall of said lid down, when the front wall of said lid is raised from said box body, wherein said swing device includes a movable rear wall portion formed by a part of the rear wall of said box body, separated from a remainder of the rear wall of said box body by a pair of slits and joined to the bottom wall of said box body by a hinge, for rotating around the hinge with respect to the remainder of the rear wall of said box body, and a connection flap joined to an upper edge of the movable rear wall portion by a fold line, the connection flap being bonded to an inner surface of the top wall of said lid to extend from the rear wall of said lid toward the front wall of said lid.

2. The swing-open type package according to claim 1, wherein said swing device further includes a transverse wall provided at a predetermined distance from the front wall of said box body to connect respective upper edges of the left and right side walls of said box body and define an access opening between the transverse wall and the front wall of said box body, and a support flap connecting the transverse wall and the inner surface of the top wall of said lid, the support flap having hinges at connecting positions with respect to the transverse wall and the inner surface of the top wall of said lid, respectively, so that the support flap assists with the swing motion of said lid by bending along the respective hinges.

3. The swing-open type package according to claim 2, wherein the swing device further includes a cut-out formed in the transverse wall, the cut-out being adapted to receive the connection flap when the lid is put over the box body.

4. The swing-open type package according to claim 2, wherein said box body, the movable rear wall portion, the connection flap and the transverse wall are formed from a single blank.

5. The swing-open type package according to claim 2, wherein the left and right side walls of said lid each have a finger engagement portion formed by a notch on a lower edge of the side wall.

6. The swing-open type package according to claim 2, wherein the swing device further includes a cut-out formed in the transverse wall, the cut-out being adapted to receive the connection flap when the lid is put over the box body.

7. The swing-open type package according to claim 2, wherein the package further comprises a sound generation device for generating a clicking sound when said lid is put onto said box body.

8. The swing-open type package according to claim 1, wherein the left and right side walls of said lid each have a finger engagement portion formed by a notch on a lower edge of the side wall.

9. The swing-open type package according to claim 1, wherein the package further comprises a sound generation device for generating a clicking sound when said lid is put onto said box body.

10. The swing-open type package according to claim 9, wherein said sound generation device includes a stopper tongue projecting outward from an upper edge of the front wall of said box body, and a recess formed in an inner surface of the front wall of said lid, wherein in the way of putting said lid onto said box body, the stopper tongue generates a clicking sound by hitting an edge of the recess with a distal end thereof when the front wall of said lid is placed on the front wall of said box and the stopper tongue is received in the recess.

11. The swing-open type package according to claim 1, wherein the connection flap is laminated on the inner surface of the top wall of said lid by face bonding.

12. The swing-open type package according to claim 1, wherein an angle between an inner surface of the movable rear wall portion and an inner surface of the connection flap is decreased from a right angle when the front wall of said lid is raised from said box body.

13. A swing-open type package which comprises:

a box body which is provided with a transverse wall which defines an access opening at a top end portion thereof, a lid having substantially the same dimensions as the box body and adapted to close on said box body and said access opening to define a chamber therebetween, a first hinge connecting the box body to the lid, the first hinge including a movable rear wall of the box body which is hinged at a bottom wall of the box body, the movable rear wall being formed by a part of a rear wall of said box body and separated from a remainder of the rear wall of said box body by a pair of slits, and a connection flap joined to an upper edge of the movable rear wall by a fold line, the connection flap being bonded to an inner surface of a top wall of said lid and extending from a rear wall of said lid toward a front wall of said lid, and a second hinge connecting the transverse wall to said lid above said access opening, whereby to open the chamber, the entire lid rotates around the first and second hinges causing a swing motion of the entire lid to shift backward from the box body providing access to said chamber through the access opening.

14. The swing-open type package of claim 13, wherein lateral portions of the lid are cut away, defining a finger engaging portion.

15. The swing-open type package of claim 13, wherein the second hinge is hinged at one end around its attachment to the transverse wall and at the other end around its attachment to the lid.

16. The swing-open type package according to claim 13, wherein the connection flap is laminated on the inner surface of the top wall of said lid by face bonding.

17. The swing-open type package according to claim 16, wherein an angle between an inner surface of the movable rear wall and an inner surface of the connection flap is decreased from a right angle when the front wall of said lid is raised from said box body to open the chamber.

* * * * *